US005445459A

United States Patent [19]

Sasaki

[11] Patent Number: 5,445,459

[45] Date of Patent: Aug. 29, 1995

[54] PRINTING APPARATUS HAVING DATA MEMORY AND METHOD THEREFOR

[75] Inventor: Ichiro Sasaki, Chita, Japan

[73] Assignee: Brother Kogyo Kabushiki Kaisha, Nagoya, Japan

[21] Appl. No.: 202,022

[22] Filed: Feb. 25, 1994

[30] Foreign Application Priority Data

Mar. 25, 1993 [JP] Japan ..... 5-092152

[51] Int. Cl.[6] ..... B41J 5/30

[52] U.S. Cl. ..... 400/76; 375/115; 375/114

[58] Field of Search ..... 400/61, 76; 395/112, 395/114, 115, 116

[56] References Cited

U.S. PATENT DOCUMENTS 4,968,159 11/1990 Sasaki et al. ..... 400/76
5,123,757 6/1992 Nagaoka ..... 400/61

FOREIGN PATENT DOCUMENTS 61-46632 3/1986 Japan ..... 400/61
1-263064 10/1989 Japan ..... 400/61

*Primary Examiner*—David A. Wiecking
*Assistant Examiner*—Steven S. Kelley
*Attorney, Agent, or Firm*—Oliff & Berridge

[57] ABSTRACT

On the basis of a received print data, a control code in the print data is analyzed to determine the print control program of a suitable command system. The print data is subjected to a processing using the print control program. The processed data is converted to dot pattern data that is usable by print control programs of different kinds of command systems and stored in a non-volatile memory. Thereafter, the stored dot pattern data is printed. Through this operation, in a printing apparatus having plural print control programs of different command systems, not only received print data, but also print data stored in the non-volatile memory can be printed using a suitable print control program.

19 Claims, 12 Drawing Sheets

START PRINT CONTROL
S10
INITIALIZATION
S11
KEY INPUT ?
NO
YES
S12
STORAGE MODE KEY INPUT ?
NO
YES
S13
MF ←1
S14
PRINT MODE KEY INPUT ?
NO
YES
S15
MF ←0
S16
COMPOSITE KEY INPUT ?
NO
YES
S17
GF ←1
S18
PRINT KEY INPUT ?
NO
YES
S19
STORAGE DATA PRINT PROCESSING
(Fig.7)
PROCESSING CORRESPONDING TO MANIPULATED KEY
S20
S21
DATA RECEIVED ?
NO
YES
S22
MF=1 ?
NO
YES
S23
STORAGE PROCESSING
(Fig.4)
S24
PRINT PROCESSING
(Fig.6)

PRINTING APPARATUS HAVING DATA MEMORY AND METHOD THEREFOR

BACKGROUND OF THE INVENTION

1. Field of the Invention

This invention relates to a printing apparatus equipped with a data memory for storing received print data, and more particularly to a printing apparatus for printing received print data or print data read out of a data memory.

2. Description of Related Art

In enterprises or the like, personal computers or work stations have been recently introduced in association with the development of an office automation, and at the same time, these computers or the like are connected to high-speed printers such as laser printers, dot printers or the like through the same cable, whereby desired print data stored in the computers or the like are transmitted, and a print processing can be performed using a desired printer.

In order to enable these printers to perform a data receiving operation for data transmitted from various computers, these printers have been generally so designed that plural kinds of print control programs having different command systems for print control are built in control devices of these printers, and a print control program suitable for the print processing is selectively set from the plural print control programs by manually manipulating an operation panel.

In U.S. Pat. No. 4,968,159, a printing apparatus is described in which a print control program is automatically selectively set from plural print control programs in an automatic selection mode on the basis of received print data. This apparatus is equipped with a storage device for temporarily storing received data.

A printing apparatus as disclosed in Japanese Laid-open Patent Application No. 1-263064 for example, is equipped with a floppy disk device for storing print data transmitted from an external equipment, a print unit and a control unit. In a printing operation, print data is first transmitted from the external equipment, and all the received print data are stored in the floppy disk device. After the storage operation is completed, the print data stored in the floppy disk device is read out and subjected to the printing operation.

There has also been conventionally known a printing apparatus equipped with a printer buffer for storing received print data.

In a case where the storage device for storing the received data as disclosed in Japanese Laid-open Patent Application No. 1-263064 is provided to the printing apparatus as disclosed in U.S. Pat. No. 4,968,159 in which plural kinds of print control programs having different command systems for print control are built in the control device thereof, and a suitable control program is automatically selected from the plural print control programs in the automatic selection mode on the basis of the received print data, the suitable print control program is automatically set in the automatic selection mode for the received print data. However, when the print data stored in the storage device is read out and printed, a suitable control program must be set by manually manipulating an operation panel because the automatic selection mode is not actuated. In this case, there occurs a problem that if the suitable print control program is not identifiable, the stored print data may not be accurately printed.

SUMMARY OF THE INVENTION

An object of this invention is to provide a printing apparatus capable of printing not only received print data, but also print data stored in a data storing apparatus using a suitable print control program.

The printing apparatus of this invention includes a print data receiving interface, an operation mode storing device for storing plural print control programs having different command systems for print control, a data processor for receiving print data received through the interface, analyzing the control code in the print data to determine the print control program whose command system is suitable for the control code, and conducting a printing operation on the print data using the determined print control program, a printer for receiving data from the data processor and printing characters or images on a print medium, a data converter for receiving the data from the data processor to convert the data to common pattern data that are usable for the print control programs of different kinds of command systems, a data storage for receiving the common pattern data from the data converter and storing the common pattern data, and a data read-out device for allowing the printer to print the common pattern data.

In the printing apparatus of this invention, the data processor serves to receive the print data through the interface, analyze the control code in the print data to determine the print control program whose command system is suitable for the control code, and conduct print data processing using the suitable print control program. The data converter serves to receive the data from the data processor and conduct a conversion processing on the data to obtain common pattern data that are usable for the print control programs of different kinds of command systems. The data storage serves to receive and store the common pattern data from the data converter. The data read-out device serves to read out the common pattern data stored in the data storage to allow the print printer to print the common pattern data.

As described above, using the print control program suitable for the received print data, the received data is converted to the common pattern data that is usable by the print control program of a different command system. Accordingly, irrespective of the currently-set print control program, the stored common pattern data can be read out and immediately printed.

As described above, according to the printing apparatus of this invention, the data converter, the data storage and the data read-out device are provided, and by the suitable print control program, the received print data are converted to common pattern data that is usable for the print control programs of different command systems and stored. Accordingly, irrespective of the currently-set print control program, the stored common pattern data are read out and immediately printed.

The common pattern data may be dot pattern data. The data storage can be stored with dot pattern data that are processed by various kinds of print control programs, and when the dot pattern data of the received print data is printed, the stored dot pattern data can be easily merged and printed.

BRIEF DESCRIPTION OF THE DRAWINGS

A preferred embodiment of the present invention will be described in detail with reference to the following figures, wherein.

DETAILED DESCRIPTION OF PREFERRED EMBODIMENTS

Preferred embodiments according to this invention will be described hereunder with reference to the accompanying drawings.

A first embodiment of this invention relates to a case where this invention is applied to a laser printer LP for receiving job print data transmitted from an external equipment such as a personal computer and for printing the received print data.

Figure 1:
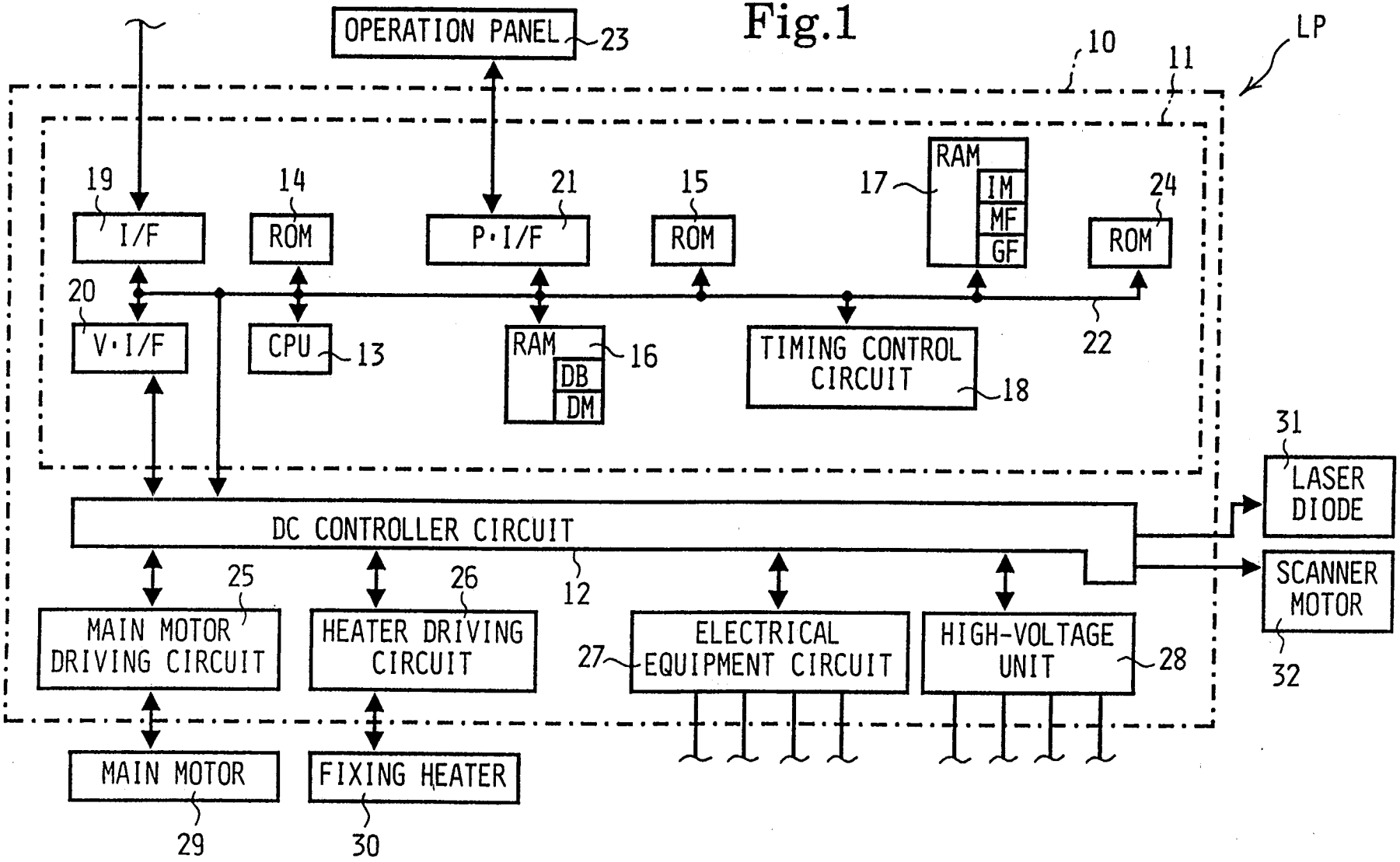
FIG. 1 is a block diagram showing a control system for a laser printer according to an embodiment of this invention.

The control system for the laser printer LP will be described with reference to a block diagram of FIG. 1. The control system is basically similar to the control system for a general laser printer, and thus, it will be briefly described.

A control unit 10 of the laser printer includes a video controller 11 and a DC controller 12.

The video controller 11 includes a CPU 13, a ROM 14 in which a print control program and various kinds of control programs are stored, a ROM 15 in which outline data for defining the outlines of many characters such as letters, symbols, etc. are stored, a RAM 16 equipped with a data buffer DB for storing a predetermined amount (corresponding to a predetermined capacity) of print data transmitted from the external equipment and a data memory DM, a ROM 24 serving as a writable non-volatile memory for storing the received print data so that the print data can be printed repetitively, an image data memory IM for storing dot pattern data that are formed on the basis of data stored in the data memory DM or non-volatile memory, a RAM 17 provided with a work memory containing a flag memory for storing data of various kinds of flags, a timing control circuit 18 for generating a timing signal when the data are written in/read out of the RAM 16, a data receiving interface (I/F) 19 for receiving the print data transmitted from the external equipment, a video interface (V·I/F) 20 includes two 4K-byte scan buffers each comprising a dual port RAM (FIFO memory) and serves to successively output to a DC controller 12 print information that is converted to dot data, and a panel interface (P·I/F) 21 for receiving signals from the operation panel 23. These elements are connected to one another through a bus 22.

The non-volatile memory 24 (ROM) comprises an electrically erasable "EEPROM", and it is generally called a "flash ROM".

Two kinds of print control programs, which are suitable for command systems (A) and (B) for controlling print data received from the external equipment, are stored in ROM 14. One system is used to control a command system optimum to document data, and the second to control a command system optimum to print complicated images (pictures), respectively.

Figure 2:
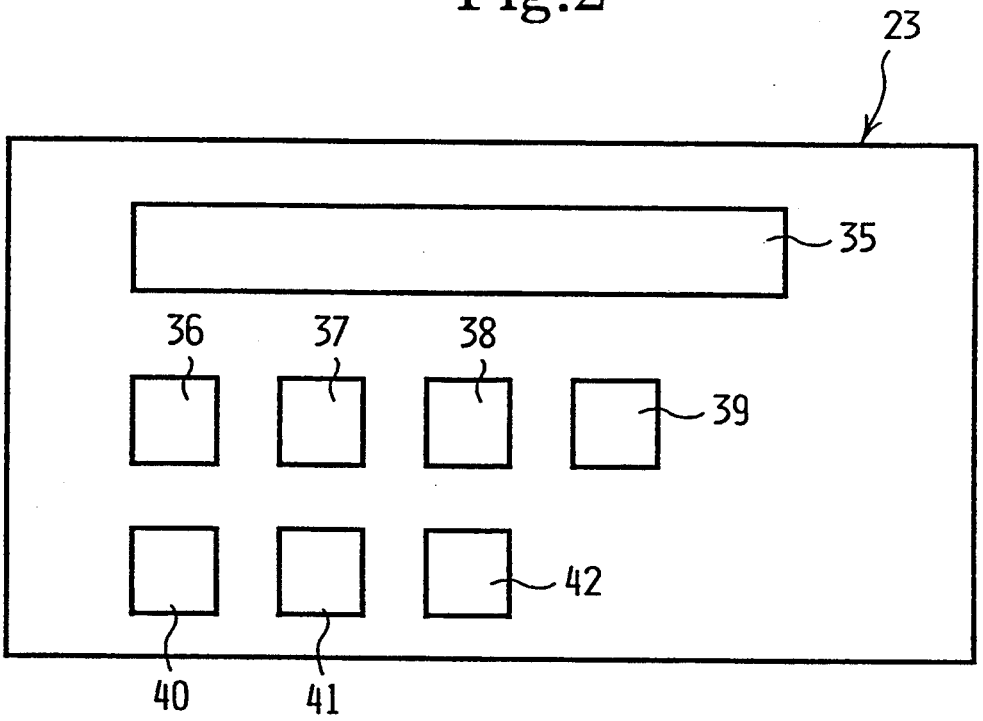
FIG. 2 is a plan view of an operation panel.
Figure 3:
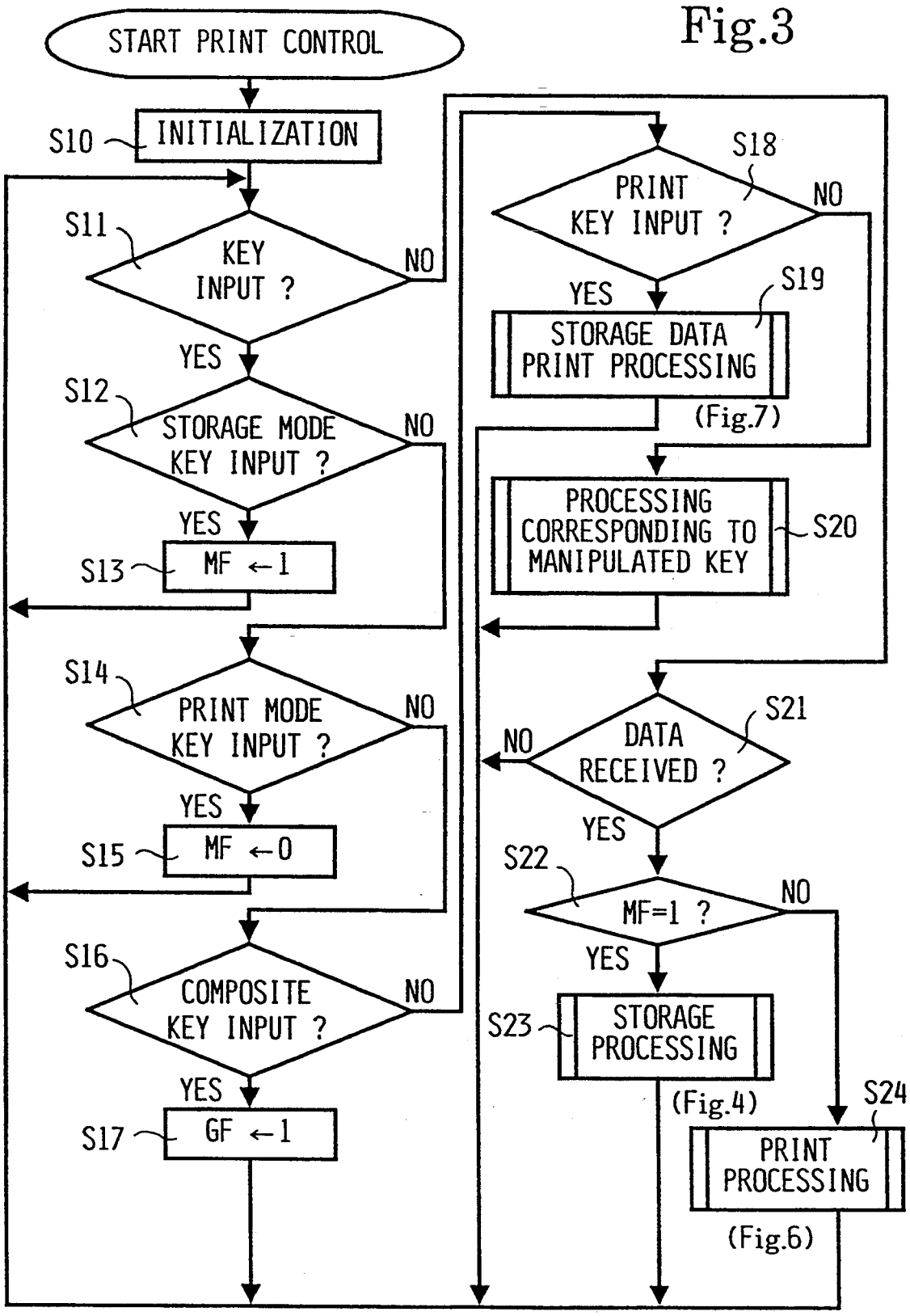
FIG. 3 is a flowchart for a routine of print control.
Figure 4:
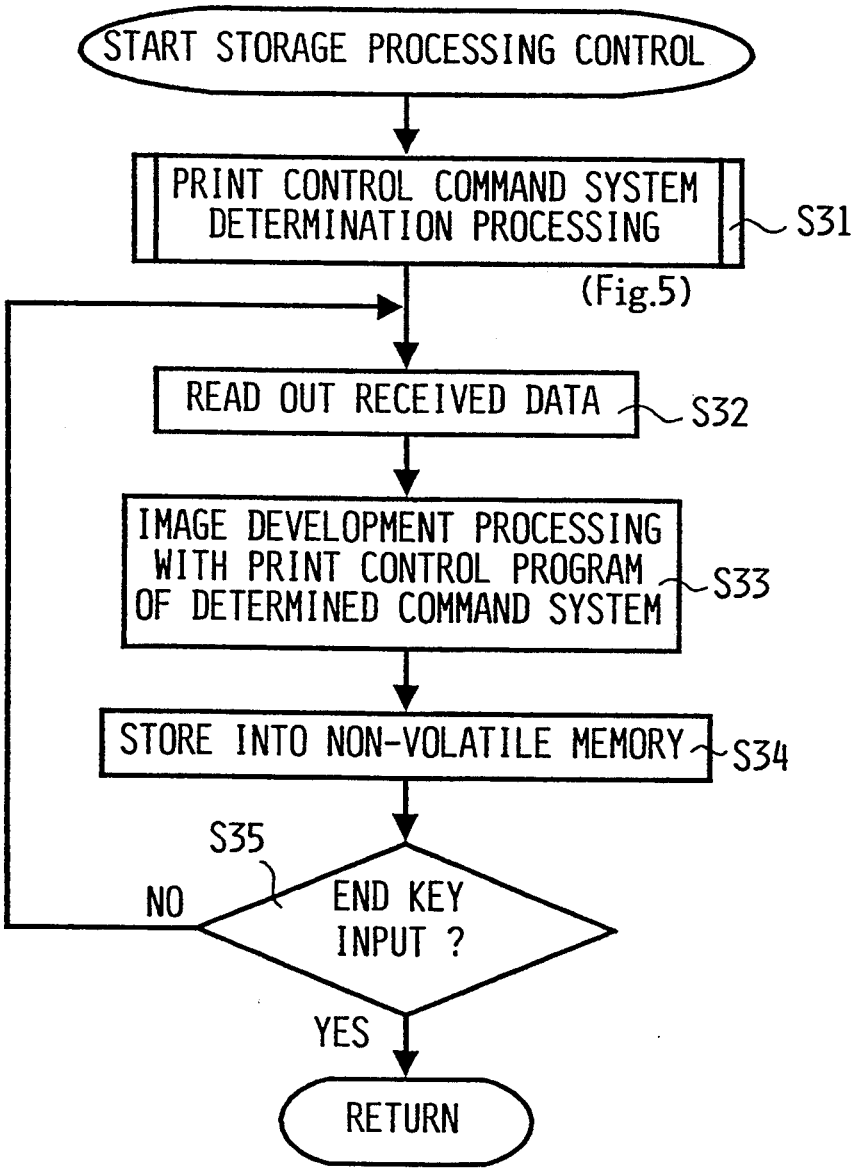
FIG. 4 is a flowchart for a routine of storage processing control.
Figure 5:
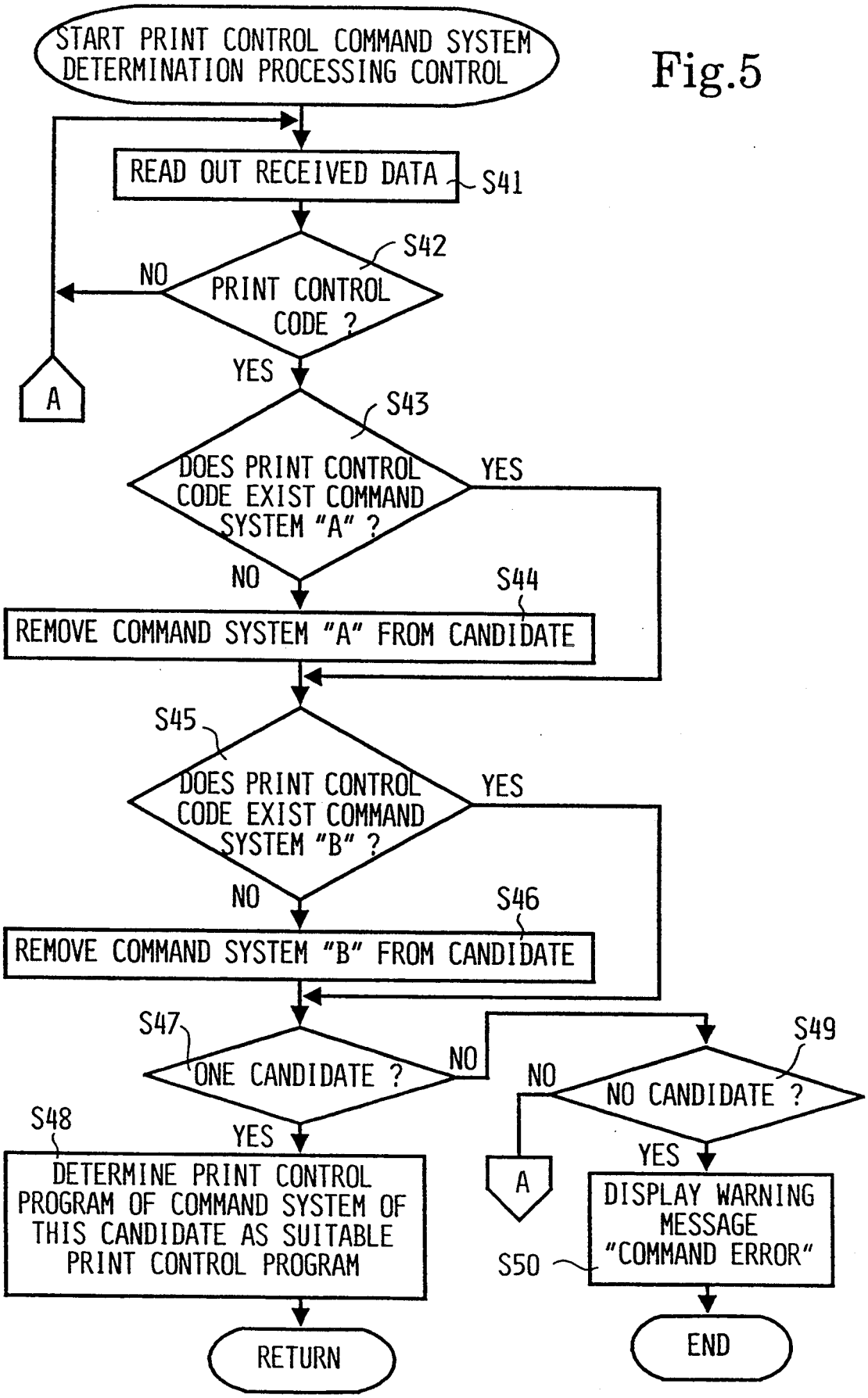
FIG. 5 is a flowchart for a routine of a print control command system determining processing control.
Figure 6:
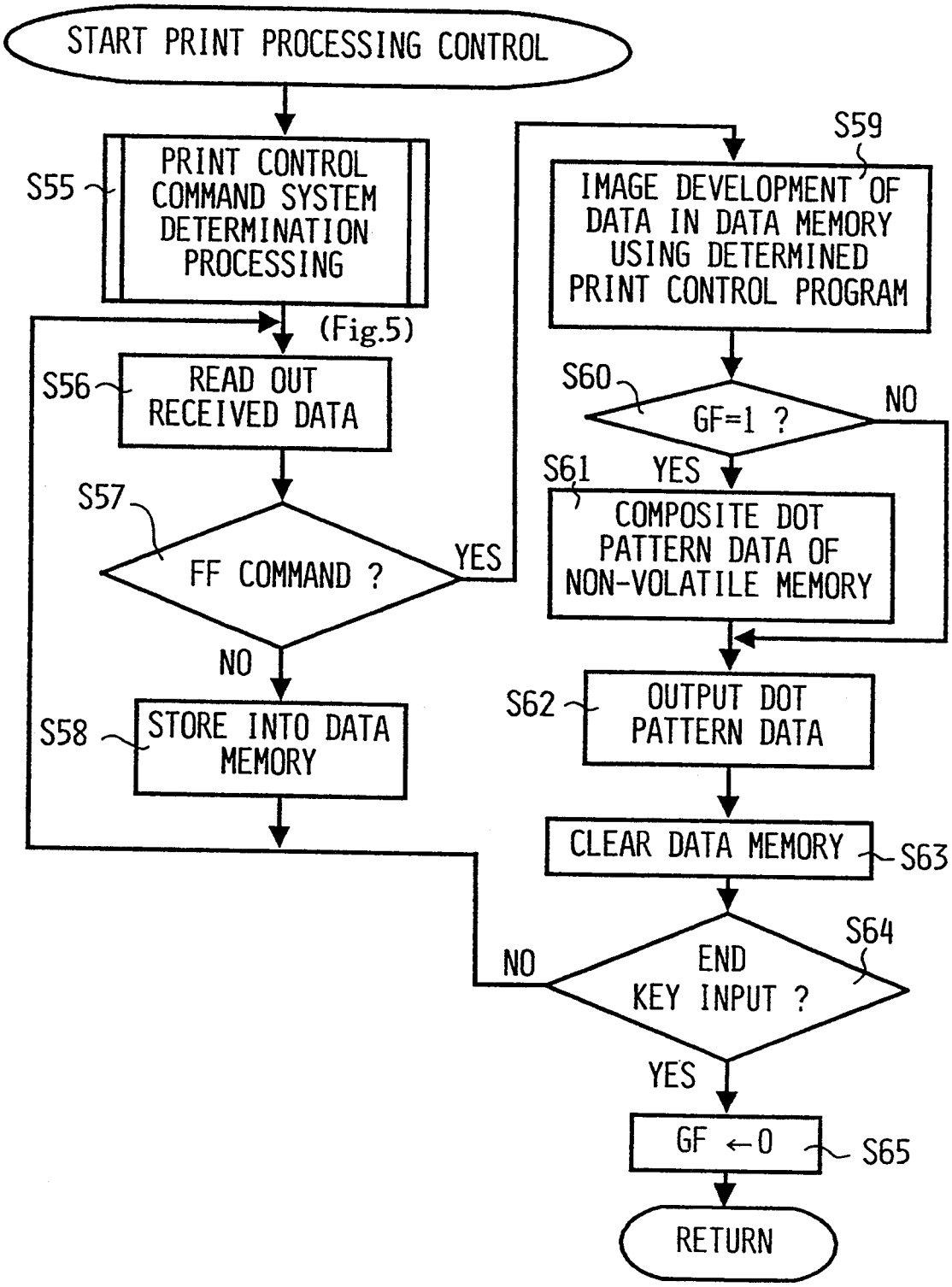
FIG. 6 is a flowchart for a routine of print processing control.
Figure 7:
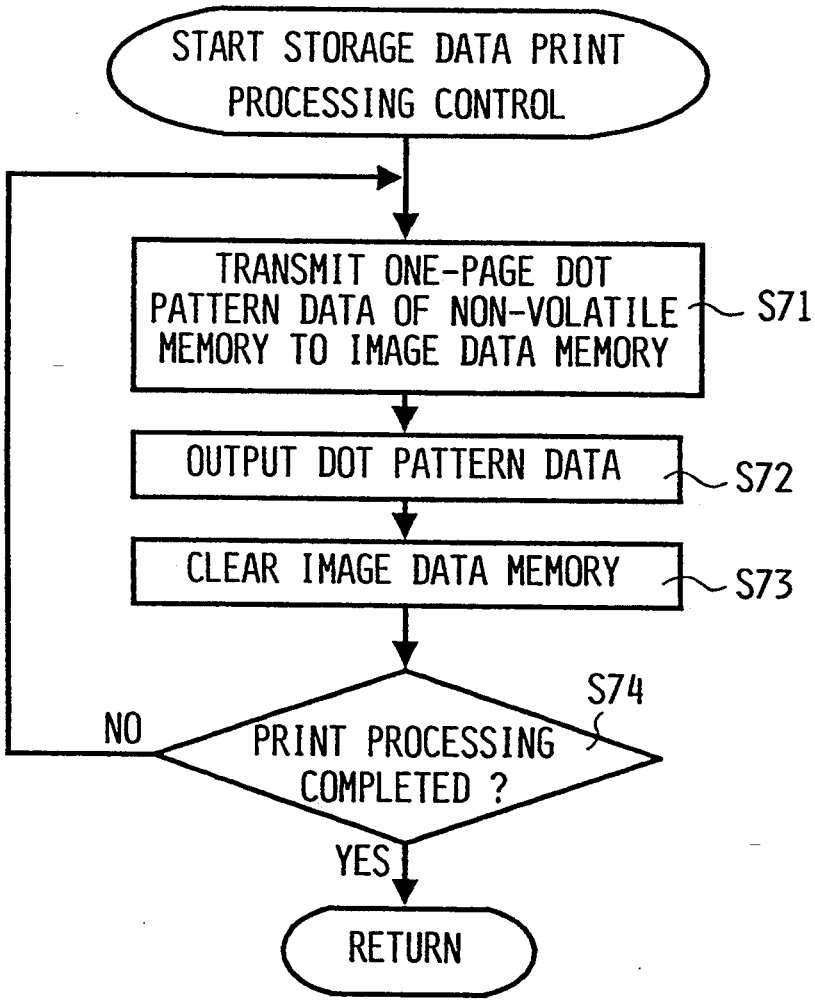
FIG. 7 is a flowchart for a routine of storage data print processing control.

As shown in FIG. 2, the operation panel 23 has a print mode key 36 for setting a print mode in which received print data is printed without being stored, a storage mode key 37 for storing the received print data in the non-volatile memory 24 without printing it, a storage number key 38 for indicating a storage number for storage of the print data into the non-volatile memory 24, an end key 39 for indicating the end of the received data, a print key 40 for indicating the print of the data stored in the non-volatile memory 24, a composite key 41 for merging the dot pattern data of the received print data and the dot pattern data stored in the non-volatile memory 24 and printing the merged data, and a mode setting key 42 for setting various kinds of operation modes. The operation panel 23 is further provided with a liquid crystal display 35 for displaying a current operation mode, etc.

DC controller circuit 12 of the control unit 10 is connected to a main motor driving circuit 25 for driving a main motor 29, a heater driving circuit 26 for driving a fixing heater 309, an electrical equipment circuit 27, and a high-voltage unit 28 for supplying high voltage inside of the control unit 10, and the DC controller circuit 12 is further connected to a laser diode 31, which is a light-emitting element of semiconductor laser, and a scanner motor 32 for rotationally driving a hexahedron mirror.

Next, the routine of the print control, which is executed in the video controller 11 of the laser printer LP, will be described with reference to the flowcharts of FIGS. 3 to 7. It is assumed that print data such as document data and image data for documents are transmitted from the external equipment. A reference character Si (i=10, 11, 12, . . .) in the figures represents a step number.

The control is started upon power-on of the laser printer, and an initialization such as clearing of the RAMs 16 and 17, etc. is first carried out (S10). Thereafter, it is judged whether any key on the operation panel 23 is manipulated. If no key is manipulated (S11: No), it is judged whether the print data is received. If no print data is received (S21: No), the program returns to the step S11.

If the storage mode key 37 is manipulated (S11, S12: Yes), a storage mode flag MF is set to set the storage mode (S13), and the program returns to step S11. If the print mode key 36 is manipulated (S11: Yes, S12: No, S14: Yes), the storage mode flag MF is reset, so that the storage mode is released, and the print mode is set (S15), thereafter, the program returns to step S11. If the composite key 41 is manipulated (S11: Yes, S12, S14: No, S16: Yes), a composite flag GM is set (S17), and the program returns to step S11.

If the storage mode is set (S22: Yes) when the print data transmitted from the external equipment is received (S11: No, S21: Yes), the storage processing control (see FIG. 4) is executed (S23).

Upon start of this control, the print control command system determination processing control (see FIG. 5) is first executed (S31). Upon start of this control, data is read out, for example, on a one-byte basis from the data buffer DB of the RAM 16 in which the received data is temporarily stored (S41). If this data is not a print control code (S42: No), the next data is successively read out (S41 to S42). If the print control code is detected (S42: Yes) and this print control code exists in the print control program of the control command system A (S43: Yes), the program goes to a step S45. However, if the print control code does not exist in the print control program of the control command system A (S43: No), this control command system A is removed from determination candidates (S49), and the program goes to step S45.

Further, if the print control code exists in the print control program of the control command system B (S45: Yes), the program goes to a step S47. On the other hand, if the print control code does not exist in the print control program of the control command system B (S45: No), this control command system B is removed from the determination candidates (S46), and the program goes to step S47. Finally, if there exists only one determination candidate (S47: Yes), the print control program of the control command system of this candidate is determined as a suitable print control program (S48). Thereafter, this control is terminated, and the program returns to step S32 of the storage processing control.

If one determination candidate cannot be specified, that is, if two determination candidates exist (S47, S49: No), step S41 and the subsequent steps thereto are executed again. On the other hand, if no determination candidate exists (S47: No, S49: yes), a warning message "command error" is displayed (S50). In this case, this control is terminated, and the storage processing control is ceased.

In the storage processing control, the received print data is read out (S32), the print data is subjected to an image development processing using the print control program thus determined so that it is converted to dot pattern data (S33), and the dot pattern data is stored in the non-volatile memory 24 (S34). If the end key 39 is not manipulated (S35: No), the program returns to step S32. When the end key 39 is manipulated in response to the termination of the reception of the print data (S35: Yes), this control is terminated, and the program returns to step S11 of the print control.

If the storage mode flag MF is reset (S22: No) when the print data transmitted from the external equipment is received (S11: No, S21: Yes), a normal print processing (see FIG. 6) is executed (S24).

Upon start of this control, the command system determination processing control (see FIG. 5) is first executed, and as described above, the print control program of the command system, which is optimum to the print control of the print data on the basis of the data in the data buffer DB, is determined (S55). When the received data is read out (S56), and it is judged that this data is not a form feed (FF) command that includes each one-page data amount in the print data or a form feed command data that is generated every time the print data reaches one-page amount (S57: No), the data is stored into the memory DM (S58), and the program returns to step S56. If the read-out data is the form feed command data (S57: Yes), character data stored in the data memory DM are image-developed to dot pattern data using the determined print control program and stored into the image data memory IM (S59).

When the composite flag GF is set (S60: Yes), the dot pattern data stored in the non-volatile memory 24 is read out, and this data is combined with the dot pattern data stored in the image data memory IM (S61). The combined dot data are output through the interface 20 to the DC controller 12 and printed on a print sheet (S62). Subsequently, the data memory DM is cleared ($63), and if the end key 39 is not manipulated (S64: No), the program returns to step S56. When the composite flag GF is reset (S60: No), step S62 and subsequent steps thereto are executed.

When the end key 39 is manipulated in accordance with the end of the print data transmitted from the external equipment (S64: Yes), the composite flag GF is reset (S65), this control is terminated, and the program returns to step S11 of the print control.

Next, when the print key 40 is manipulated to print the data stored in the non-volatile memory 24 (S11: Yes, S12, S14, S16: No, S18: Yes), the storage data print processing control (see FIG. 7) is executed (S19).

Upon start of this control, one page of dot pattern data stored in the non-volatile memory 24 are read out and transmitted to the image data memory IM (S71). The dot pattern data of one page are output through the video interface 20 to the DC controller 12 and printed on the print sheet (S72). Subsequently, the image data memory IM is cleared (S73), and if unprocessed dot pattern data exists in the non-volatile memory 24 (S74: No), step S71 and subsequent steps thereto are repetitively executed. When all dot pattern data in the non-volatile memory 24 have been subjected to print processing (S74: Yes), this control is terminated, and the program returns to step S11.

In the print control, when any key other than the storage mode key 37, the print mode key 36, the composite key 41 and the print key 40 is manipulated (S11: Yes, S12, S14, S16, S18: Yes), processing corresponding to the manipulated key is executed (S20), and the program returns to step S11.

As described above, using the print control program suitable for the received print data, the received print data is converted to dot pattern data that is usable by print control programs of different kinds of command systems and stored in the non-volatile memory 24. Therefore, irrespective of the currently-set print control program, the stored dot pattern data is read out and immediately printed if desired.

Dot pattern data that has been processed by each print control program can be stored in the non-volatile memory 24. Accordingly, when the dot pattern data of the received print data is printed, this stored dot pattern data can be easily combined and printed.

The non-volatile memory 24 is formed of a flash ROM that is electrically erasable, so that the non-volatile memory 24 can be designed to have large capacity in low cost.

Figure 8:
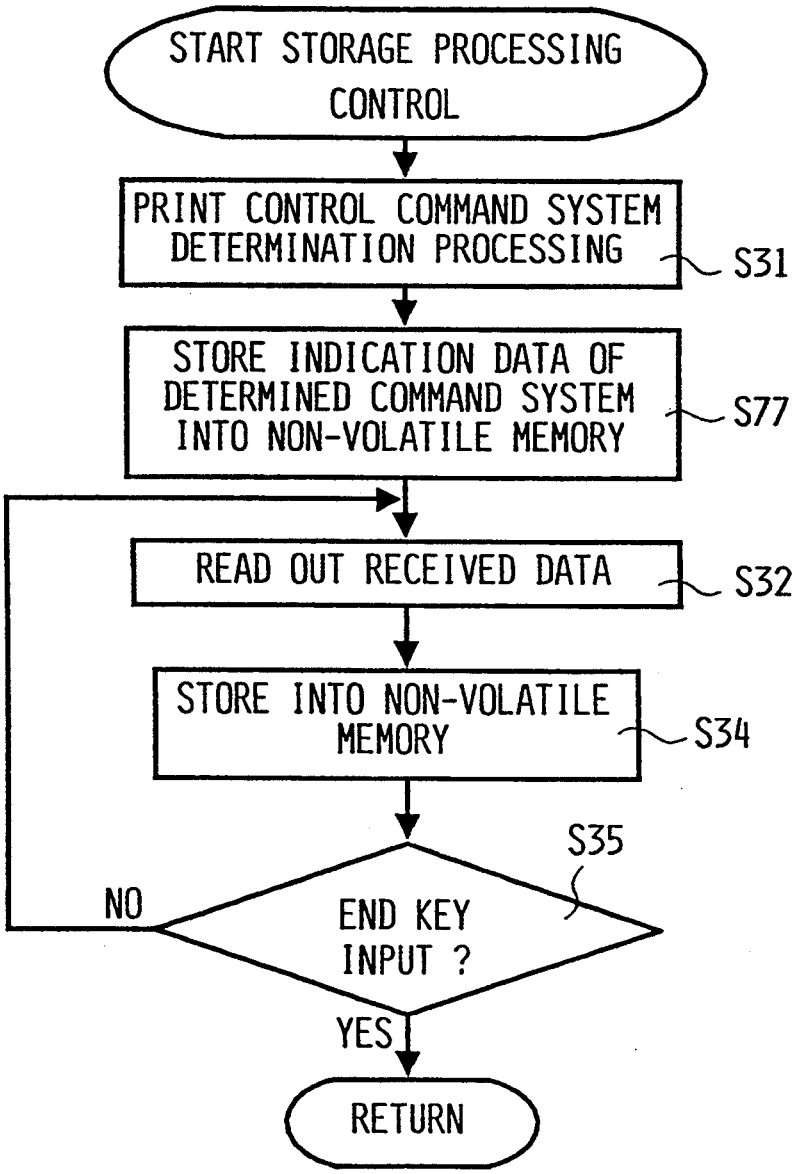
FIG. 8 is flowchart for a routine of storage processing control of a second embodiment of this invention.
Figure 9:
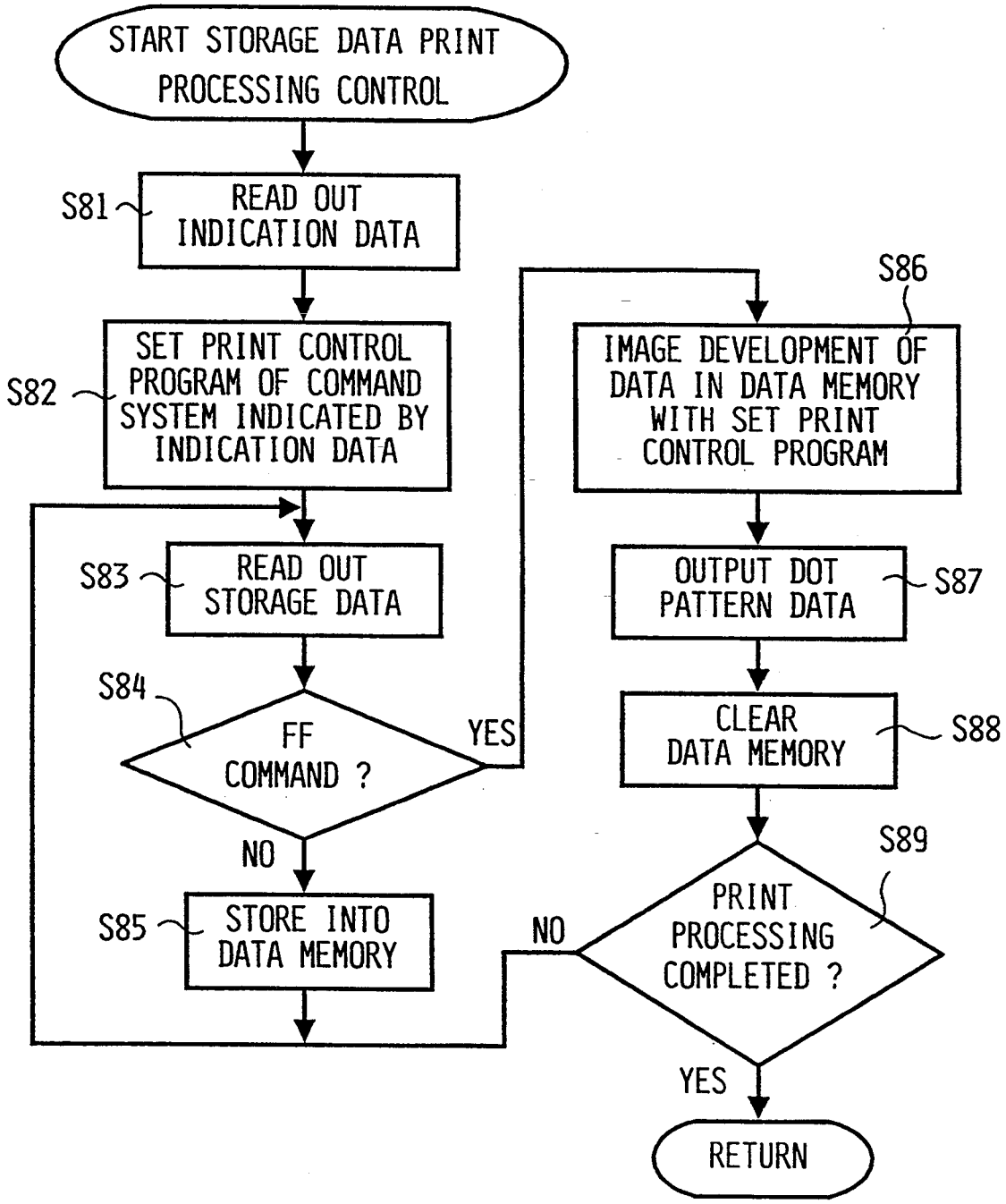
FIG. 9 is a flowchart for a routine of storage data print processing control of the second embodiment.
Figure 10:
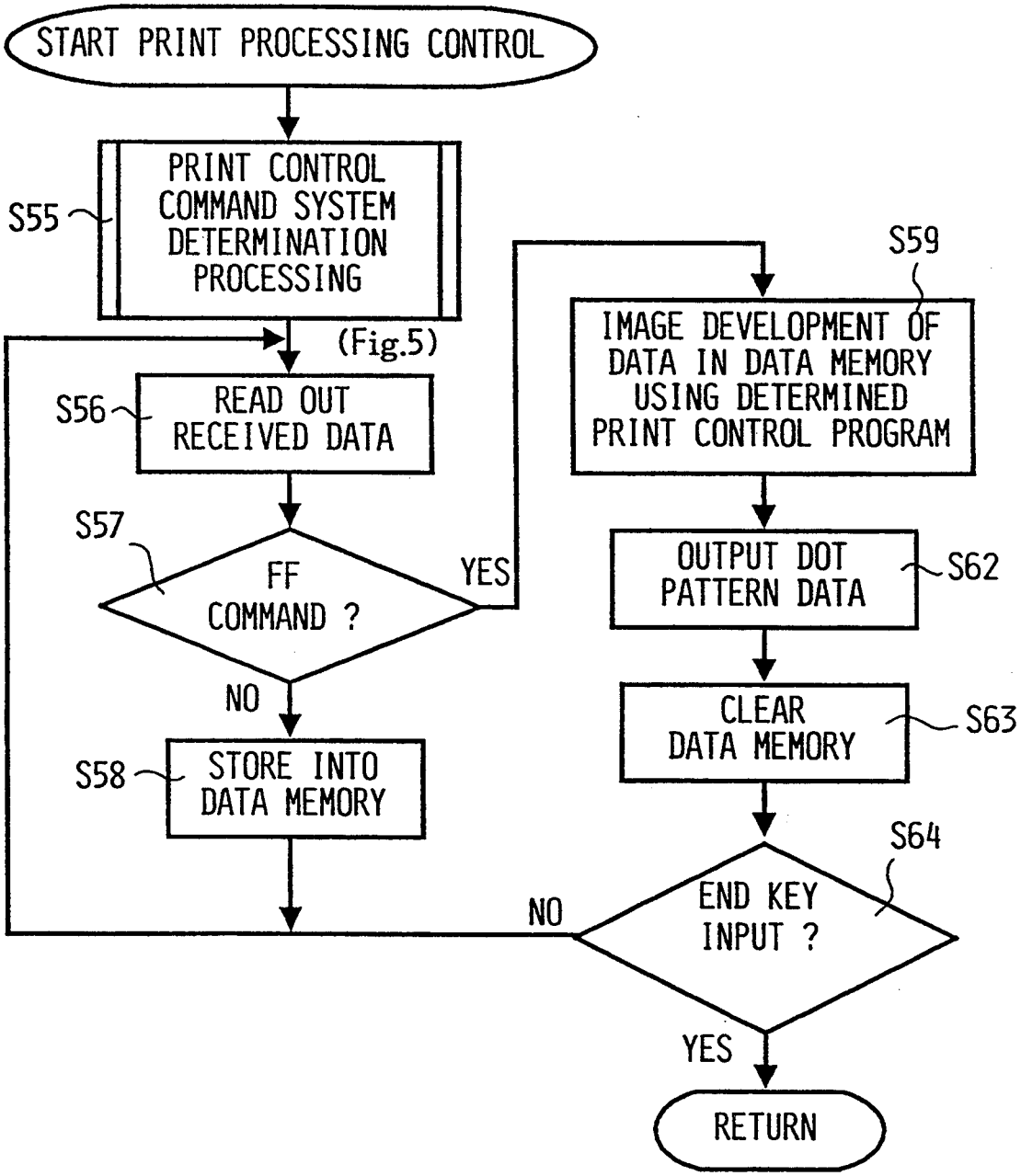
FIG. 10 is a flowchart for a routine of print processing control of the second embodiment.

In a second embodiment, the storage processing control, the storage data processing control and the print processing control are modified as shown in FIGS. 8 to 10 respectively, so that when the received print data is printed, an indication data for indicating a control command system suitable for the processing of the print data is stored incidentally to the print data. The same processing steps as the above controls are represented by the same reference step numbers.

First, the storage processing control (see FIG. 8) will be described.

Upon start of this control, the print control program of a command system that is optimum to the print control on the basis of the data in the data buffer DB is determined (S31). An indication data for the determined command system (for example, command system name data) is stored in the non-volatile memory 24 (S77). The print data is read out from the data buffer DB (S32), and this print data is stored in the non-volatile memory 24 (S34). When the end key 39 is manipulated (S35: Yes), this control is terminated, and the program returns to step S11 of the print control. In this case, the indication data is stored with the stored print data.

Next, the storage data print processing control (see FIG. 9) will be described.

Upon start of this control, the indication data is first read out from the non-volatile memory 24 (S81) to set the print control program of the control command system indicated by this indication data (S82). The storage data is read out from the non-volatile memory 24 (S83). If this data is not the form feed command data (S84: No), it is stored in the data memory DM (S85), and the program returns to step S83. If the read-out data is the form feed command data (S84: Yes), the character data stored in the data memory DM is image-developed to the dot pattern data using the set print control program as described above and stored in the image data memory IM (S86). The dot pattern data read out from the image data memory IM is output through the video interface 20 to the DC controller 12 and printed on the print sheet (S87). Subsequently, the data memory DM is cleared (S88), and if any unprocessed dot pattern data exists in the non-volatile memory 24 (S89: No), step S83 and subsequent steps thereto are repetitively executed. When all the dot pattern data in the non-volatile memory 24 are subjected to print processing (S89: Yes), this control is terminated, and the program returns to step S11.

Next, the print processing control (see FIG. 10) will be described.

Upon start of this control, the print control command system determination processing control (see FIG. 5) is first executed (S55). The received print data is stored in the data memory DM (S56, S57: No, S58). When the read-out data is the form feed command data (S57: Yes), the character data stored in the data memory DM is image-developed to the dot pattern data using the determined print control program. The dot pattern data is output for print, and the data memory DM is cleared (S59, S62, S63). When the end key 39 is manipulated (S64: Yes), this control is terminated, and the program returns to step S11.

As described above, the indication data for the print control program suitable for the processing of the received print data is stored in the non-volatile memory 24 with the print data, while the stored print data is image-developed to the dot pattern data using the print control program of the command system indicated by the indication data. Therefore, not only the received print data, but also the print data stored in the non-volatile memory 24 can be printed with no trouble.

Figure 11:
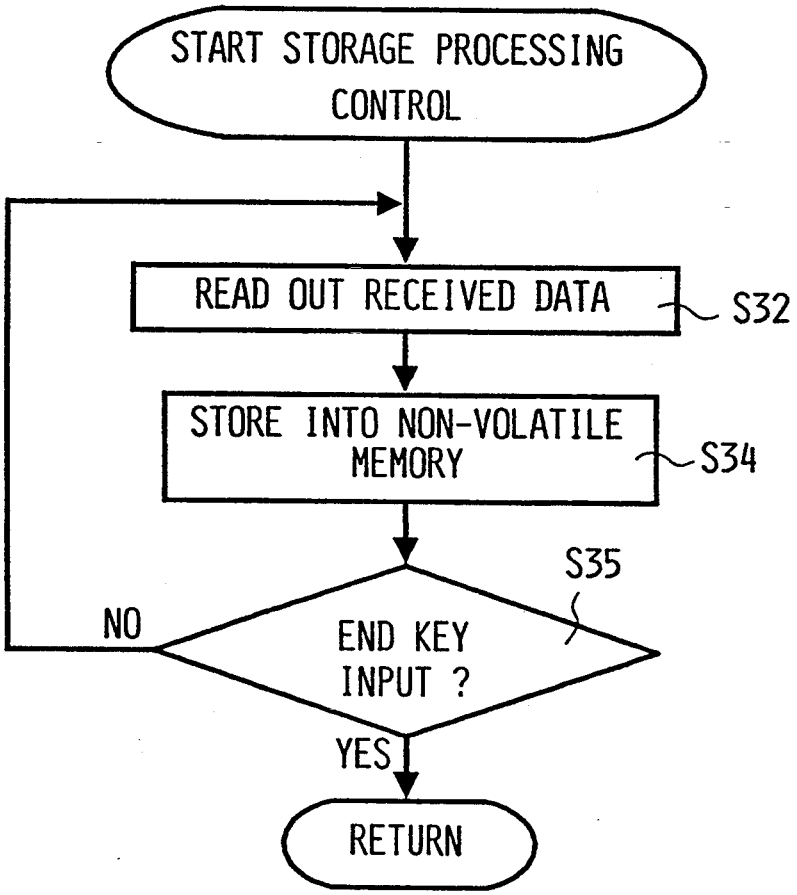
FIG. 11 is a flowchart for a routine of storage processing control of a third embodiment.
Figure 12:
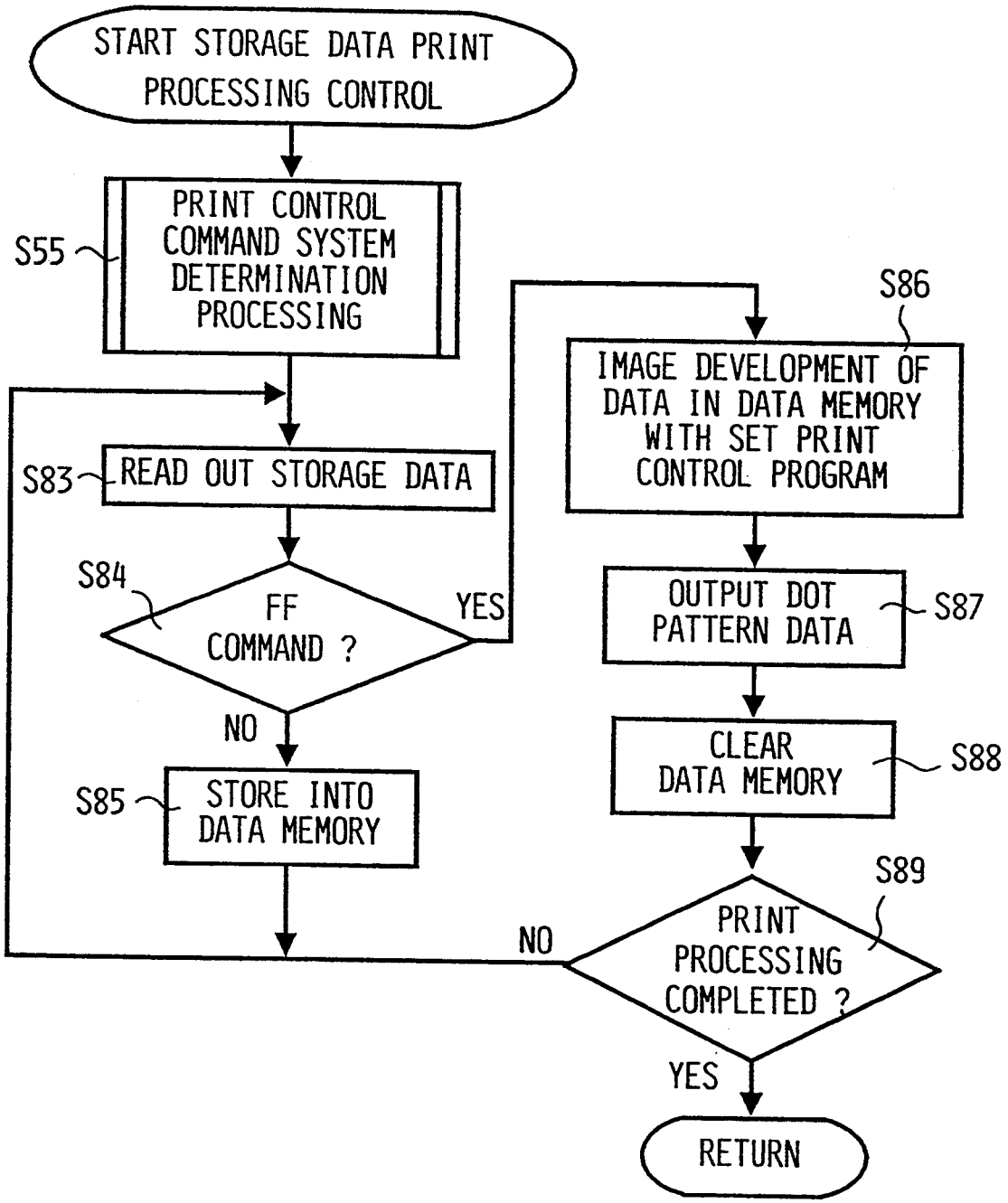
FIG. 12 is a flowchart for a routine of storage data print processing control of the third embodiment.

In a third embodiment, the storage processing control and the storage data processing control of the second embodiment are modified as shown in FIGS. 11 and 12, respectively, so that the received print data is stored in the non-volatile memory 24, and so that when the print data of the non-volatile memory 24 is printed, print processing is carried out using the print control program of the control command system suitable for the processing of the print data. The same processing steps as the above controls are represented by the same step numbers.

First, the storage processing control (see FIG. 11) will be described.

Upon start of this control, the print data stored in the data buffer DB is read out (S32) and stored in the non-volatile memory 24 (S34). When the end key 39 is manipulated (S35: Yes), this control is terminated, and the program returns to step S11.

Next, the storage data print processing control (see FIG. 12) will be described.

Upon start of this control, the print control command system determination processing control (see FIG. 5) is first executed (S55). Subsequently, like the storage data processing control (see FIG. 9), the data is developed to the dot pattern data using the set print control program and subjected to the print processing (S83 to S89).

As described above, not only the print data supplied from the interface 19, but also the print data that is read out and supplied from the non-volatile memory 24 can be subjected to the image development processing using the print control program of the suitable command system to be converted to the dot pattern data, and thus, any of these print data can be printed with no trouble.

The non-volatile memory may be an external storage device such as a hard disk driver, a floppy disk driver or the like. Of course, this invention may be applied to various kinds of printing apparatuses such as a dot print type of line printer, which is designed to receive the print data.

While the embodiments disclosed herein are preferred, it will be appreciated from this teaching that various alternatives, modifications, variations or improvements therein may be made by those skilled in the art that are within the scope of the invention, which is defined by the following claims.

What is claimed is:

1. A printing apparatus including:

a print data receiving interface;

operation mode storing means for storing plural print control programs having different command systems for print control;

data processing means for receiving print data received through said interface, for analyzing a control code in the print data to determine the print control program whose command system is suitable for the control code, and for processing the print data using the determined print control program;

printing means for receiving data from said data processing means and printing characters and images on a print medium;

data conversion means for receiving the data from said data processing means to convert the data to common pattern data that is printable by the printing apparatus without print control program processing;

data storing means for receiving the common pattern data from said data conversion means and for storing the common pattern data;

data read-out means for allowing said printing means to print the common pattern data stored in said data storing means; and setting means for selectively setting a printing operation of the print data supplied from said interface, an outputting operation of the stored common pattern data to said printing means, and a storing operation of the print data supplied from said interface into said data storing means.

2. The printing apparatus as claimed in claim 1, wherein the common pattern data comprises dot pattern data.

3. The printing apparatus as claimed in claim 1, wherein said data storing means comprises a writable non-volatile memory.

4. The printing apparatus as claimed in claim 1, wherein said data processing means comprises means for determining whether said control code exists in a first system and means for determining whether said control code exists in a second system.

5. The printing apparatus as claimed in claim 4, further comprising means for indicating a warning message if said control code does not exist in said first system or said second system.

6. A printing apparatus including:

a print data receiving interface;

operation mode storing means for storing plural print control programs of different command systems for print control;

data storing means for storing print data supplied from said interface;

data processing means for receiving print data from said interface, for analyzing a control code in the print data to determine the print control program of a command system suitable for the control code, and for processing the print data on the basis of the print control program;

printing means for receiving data from said data processing means to print characters and images on a print medium;

indication data adding means for allowing said data processing means to process the print data and set a command system when the print data is stored in said data storing means, and for allowing said data storing means to store an indication data for indicating the command system in addition to the print data;

control means for receiving the print data and the indication data from said data storing means, and for controlling said data processing means to conduct a conversion processing on the print data on the basis of the print control program of the command system indicated by the indication data to convert the print data to common pattern data that is printable by the printing apparatus without print control program processing;

data storing means for receiving the common pattern data and for storing the common pattern data;

data read-out means for allowing said printing means to print the common pattern data stored in said data storing means; and setting means for selectively setting a printing operation of the print data supplied from said interface, an outputting operation of the stored common pattern data to said printing means, and a storing operation of the print data supplied from said interface into said data storing means.

7. The printing apparatus as claimed in claim 6, wherein said data processing means comprises means for determining whether said control code exists in a first system and means for determining whether said control code exists in a second system.

8. The printing apparatus as claimed in claim 7, further comprising means for indicating a warning message if said control code does not exist in said first system or said second system.

9. A printing apparatus including:

a print data receiving interface;

operation mode storing means for storing plural print control programs of different command systems for print control;

data processing means for analyzing a control code in the print data to determine the print control program of a command system suitable for the control code, and for processing the print data on the basis of the print control program;

printing means for receiving data from said data processing means and for printing characters and images on a print medium;

data storing means for storing the print data;

setting means for selectively setting an outputting operation of the print data supplied from said interface to said printing means and a storing operation of the print data into said data storing means; and control means for controlling said data processing means to process the print data supplied from said interface to said printing means and the print data supplied from said data storing means.

10. The printing apparatus as claimed in claim 9, further including a received data buffer for storing the print data supplied from said interface, and wherein said setting means selectively sets the outputting operation of the print data stored in said received data buffer to said printing means, and the storing operation of the print data into said data storing means, and said control means controls said data processing means to process the print data stored in said received data buffer and the print data supplied from said data storing means.

11. A method of operating a printing apparatus including a print data receiving interface, the method comprising the steps of:

storing plural print control programs having different command systems for print control;

receiving print data received through said interface;

analyzing a control code in the print data to determine the print control program whose command system is suitable for the control code;

processing the print data using the print control program determined in said analyzing step;

converting the print data processed in said processing step to printable pattern data that is printable by the printing apparatus without print control program processing; and selecting one of an outputting operation of the print data received in said receiving step for printing and a storing operation of the print data for storing the print data.

12. The method according to claim 11, wherein said analyzing step comprises the steps of determining whether said control code exists in a first system and determining whether said control code exists in a second system.

13. The method according to claim 12, further comprising the step of indicating a warning message if said control code does not exist in said first system or said second system.

14. The method according to claim 11, further comprising the step of storing the printable pattern data converted in said converting step.

15. The method according to claim 14, wherein the printable pattern data comprises common pattern data, the method further comprising the step of using said common pattern data for the print control programs of different command systems.

16. The method according to claim 15, wherein the common pattern data comprises dot pattern data.

17. The method according to claim 11, wherein said converting step comprises the step of setting an indication data for indicating the command system that is suitable for the control code of the print data.

18. The method according to claim 17, wherein said converting step comprises the step of converting the print data on the basis of the print control program of the command system indicated by the indication data.

19. The method according to claim 11, wherein said analyzing step comprises the step of analyzing the print data stored in said step of storing the print data with the storing operation in said selecting step.

* * * * *